United States Patent [19]

Shiraki et al.

[11] Patent Number: 4,595,898

[45] Date of Patent: Jun. 17, 1986

[54] COMPOUND-SUPERCONDUCTING COIL

[75] Inventors: Hachio Shiraki, Kawasaki; Satoru Murase, Yokohama, both of Japan

[73] Assignee: Kabushiki Kaisha Toshiba, Kawasaki, Japan

[21] Appl. No.: 607,315

[22] Filed: May 4, 1984

[30] Foreign Application Priority Data

May 12, 1983 [JP] Japan ..... 58-81690

[51] Int. Cl.[4] ..... H01F 7/22

[52] U.S. Cl. ..... 335/216; 174/128 S

[58] Field of Search ..... 335/216; 174/128 S, 174/126 S; 336/DIG. 1, 232, 195

[56] References Cited

U.S. PATENT DOCUMENTS 4,395,584 7/1983 Ries ..... 335/216

FOREIGN PATENT DOCUMENTS 0014915 7/1980 European Pat. Off. .
0045604 10/1982 European Pat. Off. .
1564722 9/1966 Fed. Rep. of Germany .
2029076 6/1970 Fed. Rep. of Germany .
1297513 11/1972 United Kingdom .

OTHER PUBLICATIONS

7th Symposium on Eng. Problems of Fusion Research, "Selection of a Cryostabilized $Nb_3S_n$ Conductor Cooling System for the Large Coil Program", J. W. H. Chi et al, 1977.

IEEE Trans. on Mag. MAG-19, "Experimental Parameter Study of Subsize $Nb_3S_n$ Cable-in-Conduit Conductors", M. M. Steeves et al.

Nucleonics, vol. 24, No. 1, (Jan. 1966), C. H. Laverick, "Superconducting Magnets," pp. 46-53.

*Primary Examiner*—George Harris

*Attorney, Agent, or Firm*—Oblon, Fisher, Spivak, McClelland & Maier

[57] ABSTRACT

A compound-superconducting coil of the type including a plurality of superconducting wires in a tube and forcing a coolant through the tube. The subject compound-superconducting coil comprises a plurality of compound-superconducting wires and a tube for receiving the plural wires. Void spaces are provided in the interior of the tube to allow for the passage of a coolant. The void fraction is 45% to 70% of the tube interior. The subject compound-superconducting coil, when brought to a superconducting condition, allows for the passage of a current whose magnitude accounts for at least 80% of a critical current observed when the wire is strain-free state.

7 Claims, 5 Drawing Figures

COMPOUND-SUPERCONDUCTING COIL

BACKGROUND OF THE INVENTION

I. Field of the Invention

This invention relates to a compound-superconducting coil, and more particularly to a compound-superconducting coil wherein a compound-superconducting wire is held in a pipe, and a coolant such as liquid helium is forced through said pipe.

II. Description of the Prior Art:

To date, a superconducting coil constructed by winding a superconducting wire, containing a compound-superconducting material such as $Nb_3Sn$, has been put to various applications, for example, superconducting coil for nuclear fusion, NMR coil for research, and strong magnetic field coil for determining properties of matter.

The conventional compound-superconducting coil has been mainly constructed by simply winding a compound-superconducting wire into a coil. The superconducting coil thus formed has been put to practical use by dipping it in a coolant such as liquid helium and applying a magnetic field to the surrounding of said coil. Though possessed of an excellent superconducting property, the conventional superconducting coil is accompanied with the drawback that it has little mechanical strength and close care should be taken in working it into a coil, and cracks easily develop in such a coil during operation.

In "Selection of a cryostabilized $Nb_3Sn$ conductor cooling system for the Large Coil Program, 7th Smp. on Eng. Problems of Fusion Research", J. W. H. Chi et al describes a superconducting coil constructed by holding a compound-superconducting wire in a tube and forcing a coolant through the tube by means of a pump. However this proposed coil has the drawback that when the coil is continuously subjected to great bending strains, the critical current sharply drops. When the critical current of the coil stands at less than 80% of that observed during the strain-free state of the wire, the superconducting wire is damaged and fails to retrieve a superconducting property even after the current load is released. Thus, it has been impossible to manufacture a superconducting coil with a small diameter which withstands great bending strains.

SUMMARY OF THE INVENTION

It is accordingly the object of this invention to provide a compound-superconducting coil, which, even when subject to great bending strains, enables a larger amount of current than 80% of the critical current observed during the strain-free state of the superconducting coil to be conducted in a superconducting state, and is unlikely to crack during an operation.

This invention arises from the present inventors' discovery that, when the void fraction of the tube interior is chosen between about 45% to 70%, critical current does not significantly drop even if great bending strain is exerted to the coil. A superconducting coil passing such a large void fraction has not been proposed to date.

A compound-superconducting coil of this invention comprises a plurality of compound-superconducing wires and a tube for receiving said plural wires. The tube is provided with a void space allowing for the passage of a coolant. According to this invention, a fraction of said void space is chosen between 45% to 70% of the tube interior. The subject compound-superconducting coil offers the following advantages. Even if undergoing great bending strain, the coil ensures the superconductivity of a current accounting for at least 80% of a critical current observed during the strain-free state of the coil, and while being operated, the subject coil is unlikely to crack, thereby allowing the manfacturing of a small diameter superconducting coils.

DETAILED DESCRIPTION OF THE PREFERRED EMBODIMENT

A compound-superconducting coil 10 of this invention can be prepared from the same type of superconducting wire as applied in the manufacture of the conventional superconducting coil. The subject superconducting wire is prepared from a compound-superconducting material such as $Nb_3Sn$, $V_3Ga$, $Nb_3Al$ and $Nb_3Ge$. The $Nb_3Sn$-based wire includes about 1,000 to 10,000 $Nb_3Sn$-containing filaments having a diameter of, for example, about 10 $\mu$m embedded in a matrix of, for example, Cu-Sn. Said $Nb_3Sn$ wire has a diameter of, for example, about 1 mm. The manufacturing of this wire is effected by heating a wire including Nb filaments embedded in a Cu-Sn matrix, The heat treatment gives rise to the formation of a $Nb_3Sn$ layer having a thickness of 1 to 2 $\mu$m on the outside of the Nb filaments, thereby causing the finished wire to have a superconducting property. It is preferred that the heat treatment (detailed later) be carried out after inserting the wire in a tube. Part of the wires received in the tube may be substituted by hollow wires, or provided with one or more grooves lengthwise extending in the surface thereof. This arrangement can increases cooling perimeter of the wire.

Figure 2:
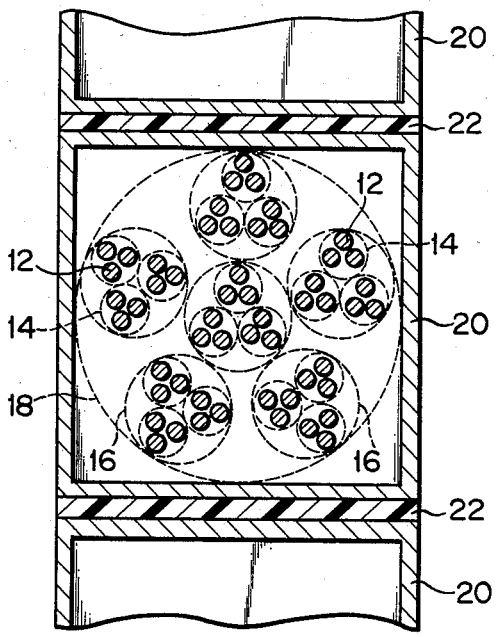
FIG. 2 is a cross partially cut off sectional view on line 2-2 of FIG. 1.

It is theoretically possible to insert the abovementioned superconducting wire in the tube. To effect the uniform passage of a coolant, however, the preferred practice comprises the steps of twisting together a plurality of wires into a cable and holding said cable in the tube. A preferred cable has a structure of $3^n \times 6$ (where n denotes a integer of more than 1 and preferably 2 to 5). The $3^n \times 6$ structure of wires is herein defined, as shown in FIG. 2, by twisting three wires 12 into a primary triplet strand 14, twisting three of the primary triplet stands 14 into a secondary triplet strands 16. The above-mentioned steps are repeated hereafter (but in the case of a $3^2 \times 6$ structure as shown in FIG. 2, the step is not repeated) until the production of triplet strands of the nth order. Last, six of said triplet strands of the nth order are twisted to provide a cable 18. This cable 18 constructed as described above ensures the uniform distribution of voids in the tube through which a coolant passes. As a result, the wires are uniformly cooled by the coolant, thus favorably increasing the current capacity of the finished superconducting cable. The twisting pitch of the triplet strand and the cable is preferably chosen as large as possible, as long as it can maintain its shape, in view of the flexibility thereof.

The aforementioned wire or cable is held in a tube 20. this tube may be prepared from any of different materials such as stainless steel, tantalum and incolloy. The thickness of the tube may be selected in accordance with the application of the subject superconducting coil. The wall of the coil is prescribed to have such a thickness as imparts a sufficient mechanical strength to the coil and allows for its easy formation. When a tube is prepared from stainless steel, the wall thickness thereof may be, for example, about 1 mm.

As cleary seen from FIG. 2, a void space is provided in the tube 20 (between the cable 18 and the inner wall of the tube 20, between the adjacent individual wires 12, between the adjacent primary triplet strands 14, and between the adjacent secondary triplet strands 16). A coolant of, for example, liquid helium is forced by a pump through the void spaces provided as described above. A total area of void spaces as compared with the cross sectional area of the tube interior is herein referred to as "a void fraction". For example, when a superconducting cables of $3^2\times6$ structure (consisting of 54 wires) having a cross sectional area of 1 $mm^2$ is inserted into a tube whose interior cross section has an area of 100 $mm^2$, the void fraction is expressed as $(100\ mm^2-54\ mm^2)/100\ mm^2\times100=46\%$. The void fraction can also be determined by photographing a cross section of the coil. A superconducting coil of this invention has a void fraction of 45% to 70%. A compound-superconducting coil having such a large void fraction has not been proposed to date. Such a large void fraction can suppress a decline in the magnitude of critical current when the subject superconducting coil sustains a great bending strain. However, if the void fraction is over 70%, the coil becomes unstable since the wires are moved by an electromagnetic force.

Figure 1:
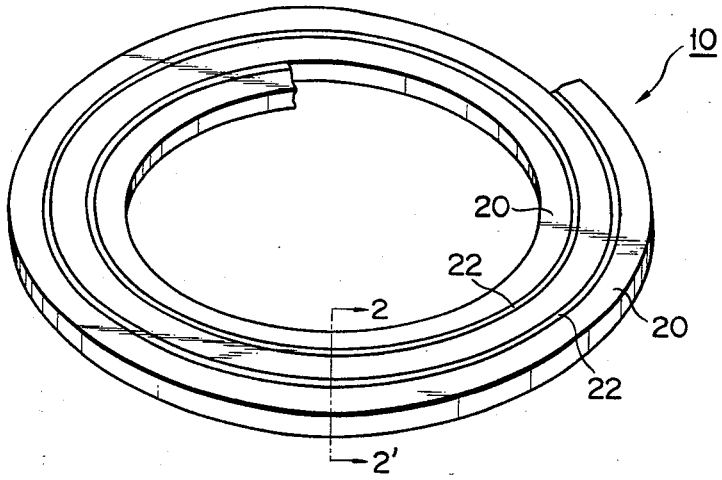
FIG. 1 illustrates the outer appearance of a compound-superconducting coil of this invention.

The above-mentioned cable-in-conduit is wound to form a superconducting coil. The manner of this winding is the same as that of the conventional superconducting coils. The winding manner include the widely known solenoid winding and pancake winding. When the tube is wound into a coil, those portions of the turns of the wound tube brought into close contact with other wound portions are preliminarily insulated. This insulation can be effected by interposing a thin sheet 22 (see FIGS. 1 or 2) prepared from an appropriate resin such as formal resin, epoxy resin, polyimide resin or glass fiber-reinforced resin between the aforesaid adjacent turns of the wound tube. The insulation sheet may be preliminarily sticked on the outer surface of the tube 20, or inserted between the adjacent turns of the tube while it is wound into a coil.

The foregoing embodiment referred to the case where all the wires are superconducting wires. However, some of the superconducting wires may be ordinary conducting wires. In this case it is preferred that those non-superconducting wires account for less than 10% of all wires. The replacement of some of the superconducting wires by ordinary electrically conducting wires favorably stabilizes the superconducting property of the resultant coil.

When the subject superconducting coil is put into practical application, both ends of the coil are connected to a pump (not shown). A proper coolant, for example, liquid helium, is forced through the aforementioned void spaces of the tube interior. The process of forcing the coolant is the same as that which has been applied in the conventional superconducting cable-in-conduit.

The above-mentioned superconducting coil of this invention is prepared by the following steps. First, wires are provided. The wires are twisted into a cable. The cable is received in a bendable tube. To put the cable into the tube, the cable is first placed on a narrow plate prepared from the tube-constituting material. The plate is folded to wrap the cable. Last, the seam of the plate is welded to provide a tube containing the cable. The cross section of the tube is reduced by being passed through a die or between two adjacent rolls, to obtain the void fraction of 45% to 70%. Last, the cable held in the tube is heat treated to form a superconducting layer on the outside of the filaments contained in the wire. It is preferrd that the heat treatment be continued for about 10 to 100 hours at a temperature of 650° to 750° C. This invention will be more apparent from the following example.

EXAMPLE

Figure 3:
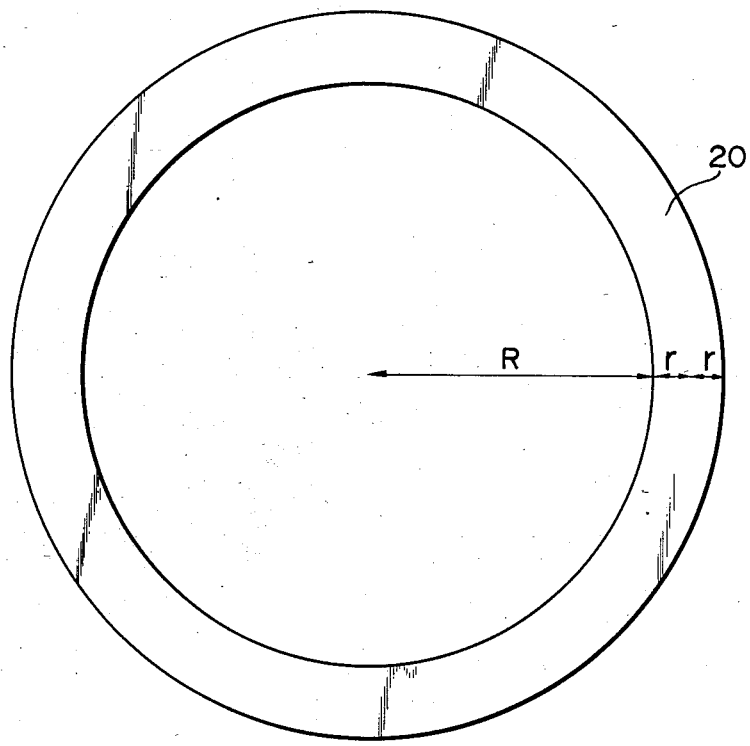
FIG. 3 is a view for explaining the definition of the term "bending strain"

Wires having a diameter of 0.3 mm including 500 Nb filaments embedded in a matrix of Cu-Sn were provided. A plurality of said wires were twisted together into cables of the previously defined $3^3\times6$ structure. The cables were each held in a stainless steel tube. The tubes had the respective cross sections reduced by means of a die to such an extent that the void fractions of the tubes accounted for 31%, 35%, 40%, 43%, 45%, 47%, 50%, 60%, 70% and 75% of the tube interior. To find out the lower limit of the void fraction of the coil, comparison was made between the magnitude of a critical current running through a compound-superconducting cable held in the tube in a strain-free condition and the magnitude of a critical current running through a plurality of sample compound-superconducting cables held in the respective tubes which were bent to sustain bending strain of 31%, 35%, 40%, 43%, 45%, 49% or 50%. The measurement of the critical current was carried out by the conventional widely accepted process. The process comprised the following steps. An object section of the superconducting coil was soldered between electrodes. The whole mass was dipped in a bath of helim liquid. A magnetic field having a magnitude of 7 Tesla units was applied to the test piece from the outside of the electrodes. Determination was made of the relationship between the current running through the superconducting body and the resultant voltage. In this case, the magnitude of a current measured when the voltage of said superconducting body stood at 1 microvolt was defined as a critical current. The bending strain $\epsilon$ is defined as follows: Assuming, as shown in FIG. 3, a tube having a width of 2r is bent in the circular form, the distance between the inner surface of the tube and the center of the circle being expressed by R. Then the bending strain $\epsilon$ is defined as $$\epsilon=r/(R+r)$$

Figure 4:
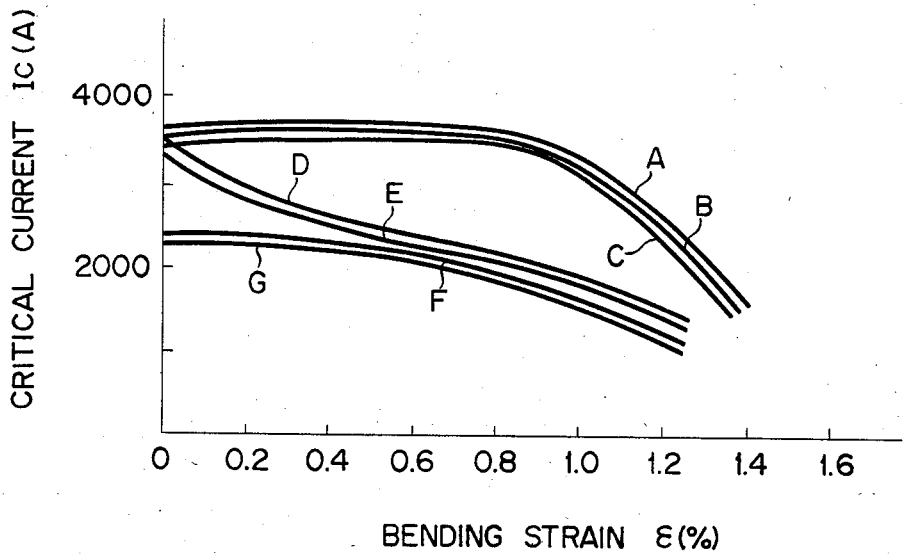
FIG. 4 is a chart indicating the relationship between the bending strain sustained by superconducting coils in bendable tubes having different void fractions and the magnitudes of critical current conducted through the superconducing coils.

The results are set forth in a curve diagram of FIG. 4. Curves A, B, C, D, E, F and G denote the bending strain of the superconducting cables held in the tubes respectively having void fractions of 50%, 47%, 45%, 43%, 40%, 35% and 31%. FIG. 4 shows that when the void fraction of a tube holding a superconducting cable is 45% or more as in this invention, a critical current retains great magnitude, and does not significantly fall even when the cable sustains great bending strains. Therefore, the compound-superconducting coil of the invention can have its diameter reduced.

Figure 5:
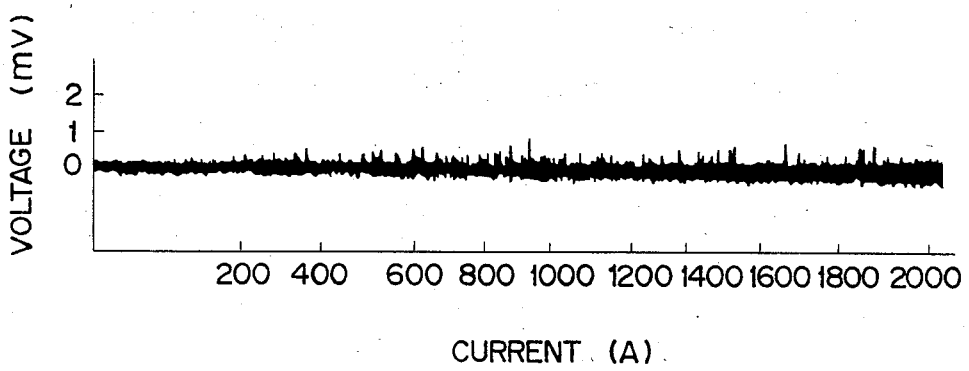
FIG. 5 shows the relationship between the intensity of current flowing through a superconducting coil having a void fraction of 75% and the voltage generated under a magnetic field of 5 teslas.

To find out the upper limit of the void fraction, the relationship between the intensity of the current flowing through the coil and the generated voltage was studied in a magnetic field of 5 teslas for the superconducting coils having the void fractions of 60%, 70% and 75%. The results about the coil with void fraction of 75% is shown in FIG. 5. In FIG. 5, the abscissa indicates the intensity of the flowing current and the ordinate indicates the electric voltage generated. As to the coils having the void fraction of 60% and 70%, substantially no voltage was generated (i.e., the coils did not move) when a current up to 2,000 A (electromagnetic force of 10.2 kg/cm) flowed. However, the coil having the void fraction of 75% presented a lot of voltage spikes as shown in FIG. 5. Thus, it can be seen that the upper limit of the void fraction is 70%. Note that although the electromagetic force of 10.2 kg/cm is 1/10 of the force which superconducting coils in practical operation receive, the magnitude of the movement of the coil tested is the same as the coil in practical use since the mechanical strength of the tested coil is 1/10 of the practically used coils.

What is claimed is:

1. A compound-superconducting coil comprising:

a plurality of wires including a plurality of compound-superconducting wires; and a wound tube which receives said plurality of wires and is provided with void spaces allowing for the passage of a coolant, and wherein the void fraction of the tube is 45% to 70%, and, in a superconducting condition, said coil allows for the passage of a current whose magnitude is at least 80% of a critical current observed before the wire is wound into a coil.

2. The compound-superconducting coil according to claim 1, wherein adjacent turns of said wound tube are insulated from each other.

3. The compound-superconducting coil according to claim 1, wherein said plurality wires jointly constitute a cable of $3^n \times 6$ structure wherein n denotes an integer of at least 2.

4. The compound-superconducting coil according to claim 3, wherein n denotes 2 to 5.

5. The compound-superconducting coil according to claim 1, wherein said plurality of wires includes a plurality of wires having ordinary electrical conducting properties.

6. The compound-superconducting coil according to claim 5, wherein about not more than 10% of said plurality of wires are constituted by wires having ordinary electrical conducting properties.

7. The compound-superconducting coil according to claim 1, wherein some of said compound superconducting wires are made hollow.

* * * * *